United States Patent [19]

Baumann et al.

[11] 4,056,142

[45] * Nov. 1, 1977

[54] HEAT EXCHANGE ARRANGEMENT

[75] Inventors: Hans Baumann, Essen; Manfred Halfmann, Ravolzhausen; Rudolf Janke, Hagen-Halden, all of Germany

[73] Assignee: GEA Luftkuhlergesellschaft Happel GmbH & Co. KG, Bochum, Germany

[ * ] Notice: The portion of the term of this patent subsequent to Apr. 20, 1993, has been disclaimed.

[21] Appl. No.: 643,509

[22] Filed: Dec. 22, 1975

Related U.S. Application Data

[63] Continuation of Ser. No. 448,379, March 5, 1974, Pat. No. 3,951,207, which is a continuation-in-part of Ser. No. 396,118, Sept. 10, 1973, abandoned.

[30] Foreign Application Priority Data

Sept. 9, 1972 Germany ..... 2244331

[51] Int. Cl.[2] ..... F28F 19/02; C23F 13/00

[52] U.S. Cl. ..... 165/133; 165/134; 204/196

[58] Field of Search ..... 165/1, 133, 134; 204/147, 196

[56] References Cited

U.S. PATENT DOCUMENTS

| | | | |
|---|---|---|---|
| 1,020,480 | 3/1912 | Cumberland | 204/196 |
| 3,354,061 | 11/1967 | Foroulis | 204/196 |
| 3,483,101 | 12/1969 | Delahunt et al. | 204/196 |
| 3,560,365 | 2/1971 | Mueller | 204/196 |
| 3,798,142 | 3/1974 | Evans | 204/196 |
| 3,951,207 | 4/1976 | Baumann et al. | 165/133 |

*Primary Examiner*—Ronald H. Lazarus
*Assistant Examiner*—Sheldon Richter
*Attorney, Agent, or Firm*—Michael J. Striker

[57] ABSTRACT

A heat exchange arrangement for use with chemically aggressive fluids has a source of direct current. Walls are provided which define a flow path for a fluid which is to undergo a temperature change, and at least a part of the walls is composed of a metallic material and connected to one of the terminals of the current source. The walls also form a chamber constituting a part of the flow path and having an opening which is closed by a cover. The cover is constituted as an electrode which is arranged in the flow path and is not in direct contact with the metallic part of the wall. This electrode is connected to the other terminal of the current source. The construction is effective for forming a protective coating on at least the metallic part of the wall when the current source is activated and fluid flows in the flow path. This protective coating prevents chemical attack of the metal by the fluid.

8 Claims, 1 Drawing Figure

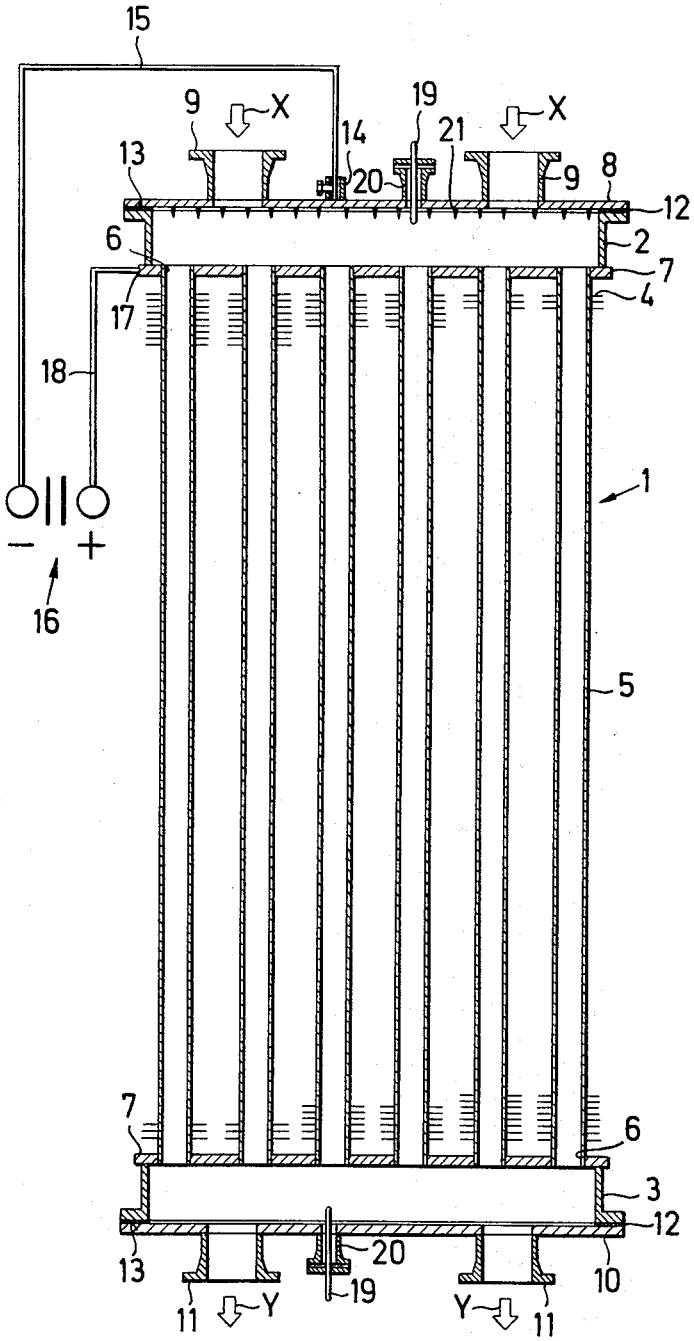
15
9
X
19
X
14
21
13
20
9
8
12
6
2
7
17
4
18
1
−
+
16
5
7
6
3
12
13
20
10
11
Y
19
Y
11

HEAT EXCHANGE ARRANGEMENT

CROSS REFERENCE TO RELATED APPLICATION

This application is a continuation of application Ser. No. 448,379, filed Mar. 5, 1974 and pending, which latter application in turn is a continuation-in-part of our earlier-filed application Ser. No. 396,118, filed on Sept. 10, 1973 and now abandoned.

BACKGROUND OF THE INVENTION

This invention relates in general to heat exchange arrangements. In particular, the invention relates to a heat exhange arrangement which is essentially composed of metallic material and serves to provide heat exchange for chemically aggressive fluids, such as sulfuric acid and the like.

Heat exchangers per se are not novel, and it is well known that many of them include conduits through which the fluid which is to undergo a temperature change is made to flow. These conduits are then contacted by a heat exchange medium, for instance a gaseous cooling medium or the like, and the outer surfaces which are so contacted may be either smooth or they may be provided with fins to facilitate the heat transfer.

Heat exchange arrangements of this general type are generally very effective and quite versatile. However, under certain circumstances, metallic heat exchange arrangements of this type present special problems. This is true, for instance, where such heat exchange arrangements are used for cooling of chemically aggressive fluids, especially of sulfuric acid, because these fluids tend to relatively rapidly corrode the material of the heat exchanger. As a general rule it has been found that the average temperature of the walls of the heat exchanger will play a significant role in determining the degree of corrosion susceptibility of the heat exchanger material. Usually, the corrosion susceptibility of the heat exchanger material increases as the temperature increases. When water is used as a cooling medium, the average wall temperature is lower than in cases where air is used as the cooling medium; this is the result of the fact that the heat transfer between water and metal is considerably better than that between air and metal. Since the heat transfer between air and metal is poorer than that between water and metal, the average wall temperature in the former case is necessarily higher than in the latter case and, in consequence, the air-cooled heat exchangers which are known from the prior art for cooling aggressive fluids are particularly susceptible to the corrosive effects of the fluid.

Ever since the aforementioned problem was identified, it has been attempted in the industry—where aggressive fluids are to be cooled by heat exchange with air—to maintain the average wall temperature as low as possible or, to put it another way, to have the temperature of the fluid to be cooled as low as possible before it is introduced into the heat exchanger. For example, where air-cooling of sulfuric acid is involved, the maximum permissible temperature prior to introduction of the acid into the heat exchanger will lie between 80 and 85° C. This temperature limit applies to a highly concentrated solution, where the sulfuric acid concentration is between 96 and 98% by weight. However, this temperature limit can be obtained only where the heat exchanger is composed of expensive, highly alloyed steel, such as, for instance, X 10 Cr Ni Ti 18 9 or X 10 Cr Ni Mo Ti 18 10. Even though corrosive effects will become apparent within a relatively short period of time.

It is also known in the art that if the flow rate of the aggressive fluid through the heat exchanger is high, a better heat transfer will be obtained. It was found, however, particularly with reference to sulfuric acid, that the corrosive action of the acid upon the metal of the heat exchanger increases significantly when a flow rate of 1 meter per second is exceeded.

Al of the limitation imposed upon the prior art by the aforementioned considerations are quite disadvantageous from a point of view of economy of operation. It is well known that it is particularly favorable to set up and operate sulfuric acid installations in such a manner that the protection temperature of the sulfuric acid can exceed 85° C. It will be recalled that, as mentioned above, heretofore this has been the critical temperature limit that could not be exceeded. To be able to operate at a temperature of the sulfuric acid in excess of 85° C means, however, that for instance in the contact process for making sulfuric acid, the process may be carried out more economically and with less of a capital inventment when higher temperatures can be employed in the contact towers. Moreover, when the temperature at which an aggressive fluid, and in particular sulfuric acid, is introduced into a heat exchanger can be increased beyond the 85° C limit, the specific thermal efficiency of the heat exchanger is also increased, due to the greater temperature differential which is obtained. It is thus clearly desirable to inhibit the corrosive effects of chemically aggressive fluids in heat exchangers, and to be able to operate such heat exchangers with the aggressive fluids, especially the sulfuric acid, at temperatures in excess of 85° C.

SUMMARY OF THE INVENTION

Accordingly, it is a general object of the present invention to provide an improved heat exchange arrangement which is avoids the disadvantages of the prior art.

More particularly, the invention has as an object to provide such an improved heat exchange arrangement which may be used for heat exchange with—and particularly for cooling of—aggressive fluids having a temperature higher than was heretofore possible on entry into the heat exchange arrangement, and which fluids tranvel at a flow rate higher than could be used until now.

Still a further invention is to provide such a novel heat exchange arrangement which has a higher specific thermal efficiency than could be obtained previously.

An additional object of the invention is to provide such a novel heat exchange arrangement which meets the aforementioned requirements and which, in addition, is less expensive to construct than prior-art heat exchangers, eliminating the need for special alloy steels and making it possible to use less expensive steels, in certain instances even non-alloyed ones.

In keeping with the above objects, and with others which will become apparent hereafter, one feature of the invention resides in a heat exchange arrangement, particularly for use with chemically aggressive fluids such as sulfuric acid and the like, which comprises a direct current source having a positive and a negative terminal. Wall means is provided defining a flow path for fluid which is to undergo a temperature change. The wall means is adapted for contact with a heat exchange medium, and at least a section of the wall means is constituted by a metallic material connected with one of the terminals of the source. Electrode means is located in the flow path and is free of electrical contact with the section of the wall means. The electrode means is connected to the other terminal of the source and is effective for forming a protective coating on at least the metallic portion of the wall means when the source is activated, and when the fluid is in the flow path, to thereby prevent chemical attack of this portion by the fluid.

Resort to the present invention eliminates or, at the very least, very significantly reduces the corrosion of the inner surfaces of the heat exchange arrangement by the chemically aggressive fluid passing through it. This is the result of the fact that the corrosion system defined by the metallic material of the heat exchanger and the electrolytes, i.e., the fluid in the flow path and, in particular, a chemically aggressive fluid such as the aforementioned sulfuric acid, is altered by the formation of a continuous or impermeable protective coating on the inner surfaces of the wall means of the metallic heat exchanger or the metallic portions thereof. The protective coating forms a passive layer the thickness of which is dependent upon the metallic material of the heat exchanger, the electrolytes and the external potential or voltage that is generated by the energy source. Depending upon the terminal of the current source to which the electrode constituting the electrode means is connected, the electode means will define either a positive or a negative pole, and the heat exchanger is then connected to the current source in such a manner as to define a pole opposite defined by the electrode means. Where the heat exchanger is connected to the negative terminal of this current source, the protective effect obtained may be referred to as cathodic protection, whereas the protective effect obtained when the heat exchanger is connected to the positive terminal of the source may be referred to as anodic protection. A rule which usually applies when the aggressive fluid is an acid is that, where the acid is an oxidizing acid, anodic protection should be used whereas, where the acid is a reducing acid, cathodic protection should be employed. However, in using this rule, consideration must still be given to the particular metallic material of the heat exchanger and the material of which the electrode means is composed, as well as to the concentration by weight of the acid itself.

The electrode means may be composed of a metallic substance, and the particular material that is suitable for this purpose can be readily determined experimentally for each corrosion system, which is also the manner in which the particular potential required of the current source can be determined.

As mentioned earlier, the present invention makes it unnecessary to use expensive highly alloyed steels for the heat exchanger. For instance, heat exchangers for cooling aggressive fluids such as sulfuric acid and the like may now be made of cheap, mass-produced steel, such as St 35.8, to name an example. Also, because of the effective protection against corrosion which is offered by the invention, the temperature of a fluid upon introduction into the heat exchanger may be increased over what was possible heretofore. If the fluid is sulfuric acid, the temperature may be increased from the previously established linit of 85° C to approximately 100°–120° C, and this higher temperature evidently allows a greater temperature differential to be obtained. In other words, the temperature difference between the fluid in the heat exchanger and the heat exchange medium may now be greater than was previously possible, with the resultant improved heat exchange effect. By comparison, the maximum temperature at which sulfuric acid could previously be introduced was 80°–85° C; the greater temperature differential and the concomitant improved heat transfer to the cooling medium which is obtained by the present invention and its possible temperature increase for the fluid to 100°–120° C, allows greater quantities of heat to be removed from the sulfuric acid. Consequently, the heat exchanger according to the present invention has a better specific thermal efficiency than the heat exchangers of the same type which are know from the prior art.

It is now also possible to substantially increase the flow rate of the aggressive fluid in the heat exchanger, due to the effective corrosion protection which is obtained. An increase in the flow rate leads to an additional increase in the specific thermal efficiency of the heat exchanger, and this provides a further advantage of the invention over the prior art. The known heat exchangers must consist of a large number of heat exchange units, the combined cross-sectional area of which must be relatively large in order to insure that the flow rate of the fluid can be low. By contrast, the novel heat exchanger according to the present invention may have a substantially smaller number of heat exchange conduits and, in addition, their combined cross-sectional area may be less than what was required in the prior art.

Still an additional advantage of the corrosion protection obtained by the present invention for the inner surfaces of the wall means, that is the surfaces which are wetted by the aggressive fluid circulating through the heat exchanger, is the fact that the fluid will be contaminated to only a linmited extent by corrosion products which develop.

Still another advantage is that, where sulfuric acid is produced by the contact process, the higher temperature of approximately 100°–120° C at which the sulfuric acid may be introduced into a heat exchanger according to the present invention, as opposed to prior-art heat exchangers, affords the advantage that the installation used for producing the sulfuric acid—particularly the contact towers of the installation—may be smaller and constructed more efficiently than was possible heretofore.

It is especially favorable, although not absolutely necessary, particularly where sulfuric acid is involved, when the electrode means is composed of or contains the same metallic material as is used for that section or those sections of the heat exchanger which are to be protected against corrosion. If the heat exchanger is to be used for operation with sulfuric acid, it is advantageous to connect the metallic section of the heat exchanger to the positive terminal of the direct current source in those instances in which the sulfuric acid being treated exceeds about 65% by weight of the fluid in the heat exchanger. If, on the other hand, the concentration of sulfuric acid in the fluid passing through the heat exchanger is less than about 65% by weight, it is recommended that the metallic section or sections of the heat exchanger be connected with the negative terminal of the direct current source.

The heat exchanger may have an inlet chamber through which the fluid enters prior to passing into the conduit or conduits, and it may also have an outlet chamber through which the fluid exits after passing through the conduit or conduits. The outer surfaces of the conduits may be provided with fins for facilitating heat exchange, or as an alternative they may also be substantially smooth.

It is particularly advantageous according to the invention that the electrode means is an electrode which is configurated as the cover for an opening of the chamber through which the fluid is admitted into the heat exchanger, and advantageously the cover, and hence the electrode, is connected to the negative terminal of the current source, and the remainder of the heat exchanger connected to the positive terminal thereof. The configuration of the cover itself as the electrode means has the particular advantage that the construction is especially simple and uncomplicated, and they can therefore be produced very readily. The end portions of the conduits may be welded to or expanded into respective end plates provided with openings in which these end portions are mounted. Since a great amount of turbulence arises in the chamber of chambers mentioned above, the ends of the conduits communicating with the chambers are especially subject to corrosion and should, therefore, be protected to a greater degree than may be necessary at upper locations of the flow path of the fluid. The provision of the electrode in form of a cover, or vice versa the provision of the cover as an electrode, makes this particularly simple and effective.

The cover is advantageously separated electrically from the adjacent wall portions of the heat exchanger by electrical insulating members, preferably members of polytetrafluoroethylene. Such insulating members prevent very reliably any electrical contact of the cover (constituting the electrode means) with the other portions of the heat exchanger. In order to increase the contact surface between the cover which is constituted as the electrode means and the aggressive fluid passing through the chamber which is closed by the cover, it is advantageous if the inner side of the cover facing the chamber be provided with ribs or fins which extend substantially normal into the chamber.

In most instances, the provision of the cover of an inlet chamber as the electrode means will be sufficient. However, in certain instances it may be advisable if an outlet chamber is also provided, and that this outlet chamber similarly has an opening which is closed by a cover constituted as an electrode. The insulation of this cover of the outlet chamber with respect to the remainder of the heat exchanger wall means may be the same as described above. Similarly, this second cover may also have the aforementioned ribs or fins. The second cover can also be connected with the same energy source as before, but it is also conceivable to use a separate energy source for it.

It has already been mentioned that the corrosive effect of aggressive fluids, particularly acids, decreases with decreasing temperature and with a corresponding decrease in the temperature of the inner surfaces of the wall means. This means that the invention makes it possible to especially protect only those inner surfaces of the heat exchanger which are exposed to fluid at a high temperature, namely an upstream portion or upstream portions of the heat exchanger, by providing only such an upstream portion or portions with the electrode means. The entire heat exchange unit may be in form of two individual heat exchangers, one which defines an upstream portion of the flow path and the other of which defines a downstream portion of the flow path. In such a case it may be advantageous to provide, for instance, only the upstream heat exchanger with the electrode means. If the temperature of the fluid on entry into this upstream portion is particularly high, the upstream portion may be composed of a highly alloyed steel, from which it follows that the downstream portion need not be made of such material and thus can be produced of cheaper steel. This makes it possible to protect different sections of the heat exchanger individually, in dependence upon the amount of protection required, by appropriately regulating the amount of protection which is afforded. Also, the heat exchanger or flow path may be subdivided into different portions or segments by providing partition means in one or more of the aforementioned chambers, to divide the chambers into compartments.

Since, for instance in the event of anodic corrosion protection, the material of which the electrode means is composed will be subjected to a certain amount of corrosion over a period of time, the electrode means must be interchanged after awhile. Since the electrode means is in form of the cover for the single chamber, or covers for the chambers at the opposite ends of the heat exchanger, such an exchange presents no problems at all.

According to a further concept of the invention, the inlet and/or outlet pipes for admitting fluid into and discharging fluid from the heat exchanger, respectively, may be electrically insulated from the latter. This will prevent a disadvantageous alteration in the corrosion protection system in a case where the inlet and/or outlet pipes are composed of a metal which is not compatible with or suitable for use in the corrosion protection system. In addition, by electrically insulating the inlet and/or outlet pipes, the consumption of electrical energy may be reduced.

In order to maintain the passive layer which affords the corrosion protection on the inner surfaces of the heat exchanger, it may also be advantageous to control or regulate the electrical parameters of the system. This means that it may be helpful to maintain the electrical parameters substantially constant or to vary them within certain predetermined limits. These parameters, of course, include the current density in the fluid or, in other words, the amount of direct current necessary to obtain the desired effects, as well as the potential, that is the DC voltage. The latter type of regulation, namely the varying of the electrical parameters within certain peredetermined limits, may, in specific instances, be accomplished by using an intermittent switching arrangement which will intermittently stop and start the supply of electrical energy. Regulation of the electrical parameters may also be effected by providing the heat exchanger and, advantageously, the wall means defining a chamber of the heat exchanger, with one or more electrically insulating and sealing members through which a measuring and regulating electrode can extend fluid-tightly into the flow path. By connecting this electrode with measuring and regulating means, the electrode may be effective for measuring the potential of the source of electrical energy and the current density in the fluid and for regulating the same, in particular, for the purpose of maintaining the potential and current density substantially constant.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE is a somewhat diagrammatic vertical illustration, showing an embodiment of the invention.

DESCRIPTION OF THE PREFERRED EMBODIMENTS

Before discussing the drawing in detail, it is emphasized that the heat exchanger shown in the drawing may be assumed to be composed substantially of St 35.8 steel, with the exception, for example, of the various insulating and sealing components. Evidently, the heat exchanger need not be composed entirely of metal since, even if only one or more sections thereof are composed of metal, the principles of the invention may be applied to such section or sections to prevent corrosion of the same. It is also emphasized that no attempt has been made in the drawing to show all of the details of such heat exchangers, since these are well known in the art. For clarity, only those details have been shown which are sufficient to illustrate the invention. Similarly, the various electrical devices and electrical connections have not been illustrated since they are not required for an understanding of the invention.

Referring now to the drawing in detail, it will be seen that reference numeral 1 identifies an air-cooled heat exchanger for cooling of a corrosive fluid, for instance sulfuric acid. It is provided with two chambers 2 and 3, into the former of which the fluid to be cooled is admitted and from the latter of which the fluid is removed in cooled condition. Connecting these chambers 2 and 3 are tubes 5 which are provided with external fins 4 and whose ends 6 are welded or otherwise secured in openings of plates 7 which constitute end walls of the respective chambers 2 and 3.

The open end of the chamber 2 is provided with a removable cover 8 formed with two inlets 9. The open end of the chamber 3 is also provided with a removable cover identified with reference numeral 10, which is provided with an outlet 11. Both covers 8 and 10 are mounted on the heat exchanger in such a manner that they are spaced from and out of electrical contact with the end faces 13 of the side walls bounding the respective chambers 2 and 3. For this purpose, electrical insulating members 12 are provided which may, for instance, be of polytetrafluoroethylene.

The fluid to be cooled is admitted into the chamber 2 as indicated by the arrows *x* and distributes itself substantially uniformly over the upper ends 6 of the heat exchange tubes 5. It then travels through these heat exchange tubes, leaving them at the lower ends 6 and entering into the chamber 3 which constitutes a collecting chamber and from which the cooled fluid exits in the direxion of the arrows *y* through the outlets 11. The supply and removal conduits have not been illustrated for purposes of simplification of the drawing.

The electrode means according to the present invention is here constituted by the cover 8 itself. For this purpose, the cover 8 is conneted via a connector 14 to an electrical conductor 15 which, in turn, is connected with the negative pole of a direct current source 16. The body of the heat exchanger, in this case the plate 7 constituting an end wall of the chamber 2, is also connected via a connector 17 with a conductor 18 that, in turn, is connected with the positive pole of the source 16. It will be appreciated that the connection to the respective terminals could be reversed, in accordance with the considerations which have been outlined earlier.

Measuring the control electrodes 19 extend into both of the chambers 2 and 3, although it is conceivable to have them provided in only one of these chambers. For this purpose, inlet members 20 are provided which may also be of polytetrafluoroethylene or other suitable insulating material, and which penetrate the respective covers 8 and 10 in fluid-tightly sealing relationship. Since these members 20 are of electrically insulating material, the electrodes which extend through them into the chambers 2 and 3 are also insulated from the respective covers and from the body of the heat exchanger 1 per se. Via non-illustrated conductors, these electrodes 19 are connected with a similarly non-illustrated regulating unit which influences the energy supplied by the source 16, that is the potential and current density in the fluid. The connection of the electrodes 19 with the regulating devices is disclosed in our aforementioned copending application to which reference may be had.

It will be seen from the drawing that in the illustrated embodiment, it is only the cover 8 that is configurated as an electrode according to the invention. The inner surface of the cover 8, that is the one facing the interior of the chamber 2, may (but need not) be provided with fins or ribs 28 of any desired configuration which extend into the chamber 2, preferably substantially normal thereto, and which facilitate electrical contact with the fluid flowing through the chamber 2.

It goes without saying that the cover 10 could also be provided as an electrode, in the same manner as the cover 8, and could be connected with the source 16 or with a separate source provided for this purpose. Similarly, the fins or ribs 21 could also be provided on the cover 10, if desired.

It will be understood that each of the elements described above, or two or more together, may also find a useful application in other types of constructions differing from the type described above.

While the invention has been illustrated and described as embodied in a heat exchange arrangement, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A heat exchanger comprising a plurality o fluid conduits adapted for receiving a hot corrosive fluid medium to be cooled; end plates connecting the said conduits; openings formed in said end plates for said conduits; walls forming an inlet chamber provided at one end of said conduits; a cover for said inlet chamber, the said conduits, end plates and walls forming the main body of the heat exchanger and the said main body and the said cover being formed of a conductive metal, the said cover being insulated from said main body of the heat exchanger, and terminals to permit connection with opposite poles of a source of direct current, one for said cover and the other for said main body, to cause flow of a current when an electrolytically active fluid is passed through said heat exchanger whereby a protective coating against corrosion is caused to form throughout the fluid-wetted surface of said cover and main body.

2. The heat exchanger of claim 1 including an outlet chamber at the end of said conduits opposite to said inlet chamber.

3. The heat exchanger of claim 1 wherein the positive pole is connected with said main body of the heat exchanger while the negative pole is connected to said cover.

4. The heat exchanger of claim 1 wherein the said main body of the heat exchanger and the said cover are made of the same metal.

5. The heat exchanger of claim 1 which is adapted for contact of the external surface of said conduits by a gaseous cooling medium.

6. The heat exchanger of claim 1 which is adapted for use with highly corrosive media of either oxidizing or reducing properties depending on the degree of concentration and wherein either of said terminals of the heat exchanger is adapted for alternative connection to one or the other of the poles of said source of direct current.

7. The heat exchanger of claim 1 which is adapted for cooling sulfuric acid of a concentration above about 65% and of a temperature in excess of 85° C, the said heat exchanger having its main body connected to the positive terminal and the cover connected to the negative terminal of the said source of electric current.

8. The heat exchanger of claim 1 wherein two sections of conduits and a connection between the two sections are provided, one section being adapted to receive the inflowing fluid medium and the other section being adapted to receive the outgoing medium and wherein only the conduits for the inflowing fluid medium are within the flow of electric current through said poles.

* * * * *